US008963981B2

(12) United States Patent
Shumiya et al.

(10) Patent No.: US 8,963,981 B2
(45) Date of Patent: Feb. 24, 2015

(54) IMAGE FORMING APPARATUS

(71) Applicant: Brother Kogyo Kabushiki Kaisha, Nagoya-shi, Aichi-ken (JP)

(72) Inventors: Kazushi Shumiya, Nagoya (JP); Tasuku Sugimoto, Nagoya (JP); Hironori Hirata, Nagoya (JP); Takayuki Tsuji, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/629,443

(22) Filed: Sep. 27, 2012

(65) Prior Publication Data

US 2013/0106972 A1 May 2, 2013

(30) Foreign Application Priority Data

Oct. 31, 2011 (JP) ..... 2011-238332

(51) Int. Cl.
*B41J 27/00* (2006.01)
*B41J 2/47* (2006.01)

(52) U.S. Cl.
CPC ..... *B41J 2/471* (2013.01)
USPC ..... 347/261

(58) Field of Classification Search
USPC ..... 347/231, 236, 237, 243, 246, 247, 347/259–261
See application file for complete search history.

(56) References Cited

U.S. PATENT DOCUMENTS

| | | | | |
|---|---|---|---|---|
| 7,248,276 | B2 * | 7/2007 | Suzuki | 347/237 |
| 7,365,765 | B2 * | 4/2008 | Dan | 347/261 |
| 8,610,754 | B2 * | 12/2013 | Nakazawa | 347/243 |
| 2010/0245521 | A1 | 9/2010 | Kubo | |

FOREIGN PATENT DOCUMENTS

| | | | |
|---|---|---|---|
| JP | S61-166602 | A | 7/1986 |
| JP | H11-129538 | A | 5/1999 |
| JP | 2010-237622 | A | 10/2010 |

* cited by examiner

*Primary Examiner* — Hai C Pham
(74) *Attorney, Agent, or Firm* — Merchant & Gould PC

(57) ABSTRACT

An image forming apparatus includes a control unit performing a first rotation control process of switching on and off current-supplying in accordance with a change in a first deviation between a first rotation speed of a brushless motor and a target speed regardless of a change in an integrated value of the first deviation; a second rotation control process of calculating an integrated value of a second deviation between a second rotation speed of the brushless motor and the target speed, and switching on and off the current-supplying in accordance with a change in the second deviation and a change in the integrated value of the second deviation; and a rotation control switching process of switching to the second rotation control process when it is determined that the first deviation has entered a prescribed range during the first rotation control process.

6 Claims, 11 Drawing Sheets

IMAGE FORMING APPARATUS

CROSS REFERENCE TO RELATED APPLICATION

This application claims priority from Japanese Patent Application No. 2011-238332 filed on Oct. 31, 2011. The entire content of this priority application is incorporated herein by reference.

TECHNICAL FIELD

The present invention relates to a technology for driving a rotating polygon mirror to rotate by using a brushless motor.

BACKGROUND

An image forming apparatus of an electrophotography type is provided with an optical scan mechanism including a rotating polygon mirror for deflecting a light beam from a light source with which a photosensitive body is irradiated. As a drive motor for driving the rotating polygon mirror to rotate, a brushless motor including a stator in which a plurality of coils is disposed and a rotor in which magnets are disposed may be used. For example, in an image forming apparatus, a plurality of Hall elements is disposed near the rotor of a brushless motor, where the timing of current-supplying to the coils is controlled by detecting the position and rotation speed of the rotor on the basis of output signals from the Hall elements. In another image forming apparatus, the timing of current-supplying to the coils is controlled by detecting the position and rotation speed of the rotor on the basis of voltages induced in the coils by the rotation of the rotor, without using the Hall elements.

Preferably, rotation control of a brushless motor involves proportional integral (PI) control so as to suppress a residual deviation between the rotation speed of the brushless motor and a target speed. However, in the technology for controlling the rotation of the brushless motor by detecting the position and rotation speed of the rotor on the basis of a change in magnetic flux produced in the coil, such as via the output signals from the Hall elements or the induced voltages in the above image forming apparatuses, the detected result of the rotation speed is greatly varied by the influence of noise and the like. Thus, if the well-known PI control is simply utilized in rotation control of the brushless motor, the rotation of the brushless motor may not be normally controlled because of an unwanted increase in integrated factors due to the fluctuation in rotation speed.

In the present specification, a technology for overcoming the inability to normally control the rotation of a brushless motor due to fluctuation in rotation speed caused by a change in magnetic flux of a coil is disclosed.

SUMMARY

In one aspect of the present invention, an image forming apparatus includes a light source emitting a light beam; a photosensitive body; a brushless motor including a stator with a plurality of coils and a rotor with a magnet; a rotating polygon mirror driven by the brushless motor to rotate and periodically deflect the light beam emitted by the light source so as to form scan lines successively on the photosensitive body; a current-supplying switching unit switching on and off current-supplying to the coils so as to rotate the brushless motor; a magnetic flux change detection unit outputting a detection signal in accordance with a change in a magnetic flux of the coils caused by the rotation of the rotor; an optical sensor outputting a photoreception signal in accordance with the presence or absence of reception of the light beam deflected by the rotating polygon mirror; and a control unit. The control unit performs a first rotation control process of switching on and off the current-supplying by the current-supplying switching unit in accordance with a change in a first deviation between a first rotation speed of the brushless motor based on the detection signal and a target speed regardless of a change in an integrated value of the first deviation; a second rotation control process of calculating an integrated value of a second deviation between a second rotation speed of the brushless motor based on the photoreception signal and the target speed, and switching on and off the current-supplying by the current-supplying switching unit in accordance with a change in the second deviation and a change in the integrated value of the second deviation; a speed determination process of determining whether the first deviation is within a prescribed range; and a rotation control switching process of switching to the second rotation control process when, during the first rotation control process, it is determined by the speed determination process that the first deviation has entered the prescribed range from outside the prescribed range.

In another aspect of the present invention, an image forming apparatus includes a light source emitting a light beam; a photosensitive body; a brushless motor including a stator with a plurality of coils and a rotor with a magnet; a rotating polygon mirror driven by the brushless motor to rotate and periodically deflect the light beam emitted by the light source so as to form scan lines successively on the photosensitive body; a current-supplying switching unit switching on and off current-supplying to the coils so as to rotate the brushless motor; a magnetic flux change detection unit outputting a detection signal in accordance with a change in a magnetic flux of the coils caused by the rotation of the rotor; and a control unit. The control unit performs an integration process of calculating an integrated value of a deviation between a rotation speed of the brushless motor based on the detection signal and a target speed; a rotation control process of switching on and off the current-supplying by the current-supplying switching unit in accordance with a change in the deviation and a change in the integrated value; a plus or minus determination process of determining whether plus or minus signs of the deviation and the integrated value correspond with each other; and an integrating operation switching process in which, when it is determined that the plus or minus signs correspond to each other, an operation of integrating the deviation is terminated when a sum value between the deviation and the integrated value reaches an upper-limit value, and in which the operation of integrating the deviation is performed regardless of whether the sum value reaches the upper-limit value when the plus or minus signs are different from each other.

In another aspect of the present invention, an image forming apparatus includes a light source emitting a light beam; a photosensitive body; a brushless motor including a stator with a plurality of coils and a rotor with a magnet; a rotating polygon mirror driven by the brushless motor to rotate and periodically deflect the light beam emitted by the light source so as to form scan lines successively on the photosensitive body; a current-supplying switching unit switching on and off current-supplying to the coils so as to rotate the brushless motor; a magnetic flux change detection unit outputting a detection signal in accordance with a change in the magnetic flux of the coils caused by the rotation of the rotor; and a control unit. The control unit performs an integration process of calculating an integrated value of a deviation between a rotation speed of the brushless motor based on the detection signal and a target speed; a rotation control process of switching on and off the current-supplying by the current-supplying switching unit in accordance with a change in the deviation and a change in the integrated value; and an integrating operation terminating process of terminating an operation of integrating the deviation when the deviation reaches an upper-limit value.

In yet another aspect of the present invention, an image forming apparatus includes a light source emitting a light beam; a photosensitive body; a brushless motor including a stator with a plurality of coils and a rotor with a magnet; a rotating polygon mirror driven by the brushless motor to rotate and periodically deflect the light beam emitted by the light source so as to form scan lines successively on the photosensitive body; a current-supplying switching unit switching on and off current-supplying to the coils so as to rotate the brushless motor; a magnetic flux change detection unit outputting a detection signal in accordance with a change in a magnetic flux of the coils caused by the rotation of the rotor; an optical sensor outputting a photoreception signal in accordance with the presence or absence of reception of the light beam deflected by the rotating polygon mirror; and a control unit. The control unit performs a first rotation control process of calculating an integrated value of a first deviation between a first rotation speed of the brushless motor based on the detection signal and a target speed, and switching on and off the current-supplying by the current-supplying switching unit in accordance with a change in the first deviation and a change in the integrated value of the first deviation; a second rotation control process of calculating an integrated value of a second deviation between a second rotation speed of the brushless motor based on the photoreception signal and the target speed, and switching on and off the current-supplying by the current-supplying switching unit in accordance with a change in the second deviation and a change in the integrated value of the second deviation; a speed determination process of determining whether the first deviation between the first rotation speed and the target speed is within a prescribed range; and a rotation control switching process of switching from the first rotation control process to the second rotation control process when it is determined by the speed determination process that the first deviation has entered the prescribed range from outside the prescribed range during the first rotation control process, with a value not more than the integrated value of the first deviation at the time of the determination set as an initial value of the integrated value of the second deviation.

DETAILED DESCRIPTION OF THE ILLUSTRATIVE ASPECTS

<First Illustrative Aspect>

A first illustrative aspect will be described with reference to FIGS. 1 to 6.

(Configuration of Laser Printer)

Figure 1:
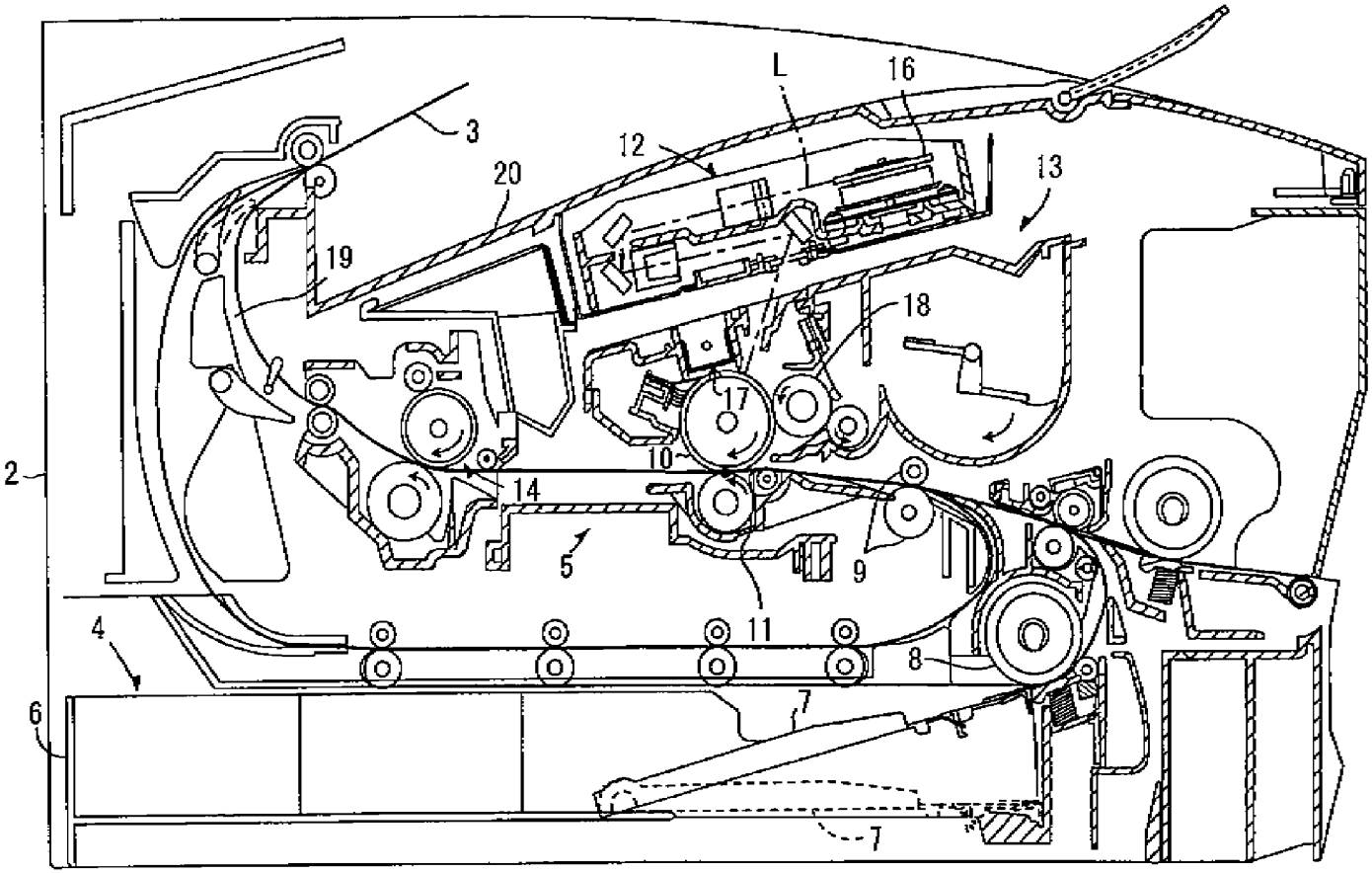
FIG. 1 illustrates the internal configuration of a laser printer according to a first illustrative aspect.

As illustrated in FIG. 1, a laser printer 1 according to the present illustrative aspect is provided with a main body frame 2. The main body frame 2 houses, for example, a feeder unit 4 feeding sheets 3, such as sheets of paper, and an image forming unit 5 forming an image on the sheet 3 that has been fed.

The laser printer 1 is an example of an image forming apparatus and may be not only a single-color printer but also a color printer for two or more colors. Other image forming apparatuses may be used as long as they have the printer function, such as a multifunction peripheral with the functions of a facsimile, a copier, and a reader (scanner).

The feeder unit 4 includes a sheet tray 6, a pressing plate 7, a pickup roller 8, and a pair of registration rollers 9. The pressing plate 7 is rotated about a rear-end portion of the plate such that the upper-most one of the sheets 3 on the pressing plate 7 can be pressed against the pickup roller 8. The sheets 3 stored in the sheet tray 6 are fed out one sheet at a time as the pickup roller 8 is rotated. The sheet 3 that has been fed out is registered by the registration rollers 9, 9 and then sent to a transfer position. The transfer position is the position where a toner image on a photosensitive body 10 is transferred onto the sheet 3 and where the photosensitive body 10 is brought into contact with a transfer roller 11.

The image forming unit 5 includes a scanner unit 12, a process cartridge 13, and a fusing unit 14, for example. The scanner unit 12 includes a light source 15 (see FIG. 2), a polygon mirror 16, and the like. The light source 15 emits laser light L with which a surface of the photosensitive body 10 is irradiated while the laser light L is periodically deflected by the polygon mirror 16. The details of the scanner unit 12 will be described later. The polygon mirror 16 is an example of a rotating polygon mirror, and the laser light L is an example of a light beam.

The process cartridge 13 includes the photosensitive body 10, a scorotron charger 17, and a development roller 18, for example. The charger 17 positively and uniformly charges the surface of the photosensitive body 10. The charged surface of the photosensitive body 10 is exposed by the laser light L from the scanner unit 12 to form an electrostatic latent image thereon. The electrostatic latent image is developed as the toner carried on the surface of the development roller 18 is supplied, and then transferred onto the sheet 3 at the transfer position. After the toner is thermally fused onto the sheet 3 by the fusing unit 14, the sheet 3 is ejected onto an ejected paper tray 20 via a paper ejection path 19.

(Configuration of Scanner Unit)

Figure 2:
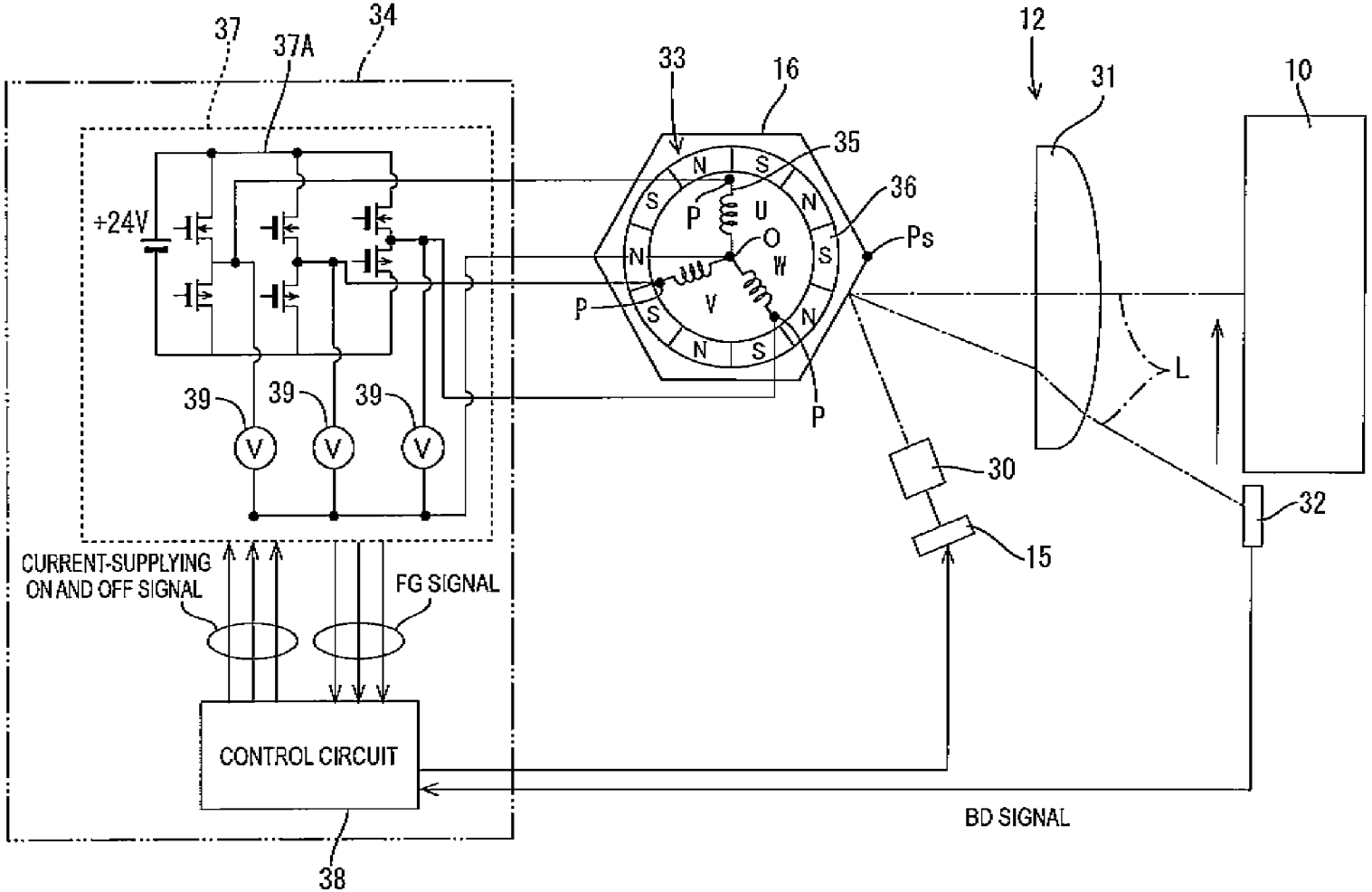
FIG. 2 is a schematic diagram illustrating the configuration of a scanner unit.

As illustrated in FIG. 2, the scanner unit 12 is provided with the light source 15 emitting the laser light L, such as a semiconductor laser; a first lens unit 30; the polygon mirror 16; a second lens unit 31; an optical sensor 32; a brushless motor 33; and a control board 34, for example.

The first lens unit 30 is configured from a collimator lens, a cylindrical lens, and the like, and transmits the laser light L emitted by the light source 15 to irradiate the polygon mirror 16. The second lens unit 31 is configured from an fθ lens, a cylindrical lens, and the like, and transmits the laser light L deflected, i.e., reflected, by the polygon mirror 16 to irradiate the photosensitive body 10.

The polygon mirror 16 is configured from six mirror surfaces, for example, and is rotated at high speed by the brushless motor 33. The polygon mirror 16 as it is rotated at high speed periodically deflects the laser light L emitted from the light source 15 such that scan lines are successively formed on the photosensitive body 10 via the second lens unit 31. The scan lines are dot-like exposing lines corresponding to each of line data of image data. The scan lines are not formed where the line data corresponds to a blank portion of the image.

The brushless motor 33 is a three-phase brushless DC motor and includes a stator 35 in which a U phase, a V phase, and a W phase coils are disposed, and a rotor 36 in which field-forming permanent magnets are disposed. In the example illustrated in FIG. 2, the coils of the brushless motor 33 are arranged in the star connection, with the rotor 36 having ten-pole field-forming permanent magnets. The polygon mirror 16 is rotated together with the rotor 36.

On a control board 34, a drive circuit 37 driving the brushless motor 33 to rotate, a control circuit 38, and the like are mounted. The drive circuit 37 includes an inverter 37A, for example, for switching on and off the current-supplying, or activating and deactivating, of the coils. The inverter 37A is an example of a current-supplying switching unit. The control circuit 38 performs an emission control for the light source 15 and a rotation control for the polygon mirror 16. The configuration of the control circuit 38 will be described later.

The optical sensor 32 is disposed at a position enabling the reception of the laser light L before the laser light L deflected by the polygon mirror 16 reaches the photosensitive body 10. The optical sensor 32 is used for determining the start timing of writing of each scan line by the laser light L, and receives the laser light L from the light source 15 and output a beam detection (BD) signal to the control circuit 38. The BD signal is an example of a photoreception signal. The optical sensor 32 may be disposed at a position enabling the reception of the laser light L after the laser light L has passed through the photosensitive body 10.

(Configuration for Rotor Position Detection)

The control circuit 38 detects the position of the rotor 36 without using a position detection element, such as a Hall element. Specifically, the control circuit 38 detects the position of the rotor 36 on the basis of a voltage induced in each coil as the rotor 36 is rotated with respect to the stator 35.

As the rotor 36 rotates, the S-pole magnets and the N-pole magnets alternately approach, and thereby magnetize the coils, whereby the magnetic fluxes in the coils are changed and an induced voltage is produced in each coil. The impedance of the coils varies depending on whether the approaching magnet is of the S-pole or the N-pole. Thus, the induced voltage has a waveform, such as a sine wave, that is periodically changed to different levels depending on whether the S-pole or the N-pole has approached. Accordingly, by detecting the induced voltages, the position of the rotor 36, i.e., the magnet of which pole is approaching the coils, can be detected.

The induced voltages may be detected by the following configuration. As illustrated in FIG. 2, the drive circuit 37 includes three voltage detection circuits 39, 39, 39 corresponding to the respective coils. The voltage detection circuits 39, which are an example of a magnetic flux change detection unit, outputs a detection signal in accordance with a voltage difference between a terminal point P of the corresponding coil and a central point O of the star connection. The terminal point P is the terminal portion of the coils via which the coils are connected to the drive circuit 37. The voltage difference includes the induced voltage. The drive circuit 37 may include a comparator, not illustrated, converting the detection signals into high and low signals whose levels are inverted in accordance with the change in the induced voltages caused by switching in the polarity of the magnet that approaches the coils, and feed the high and low signals to the control circuit 38. In the following, the high and low signals will be referred to as "FG signals".

Figure 3:
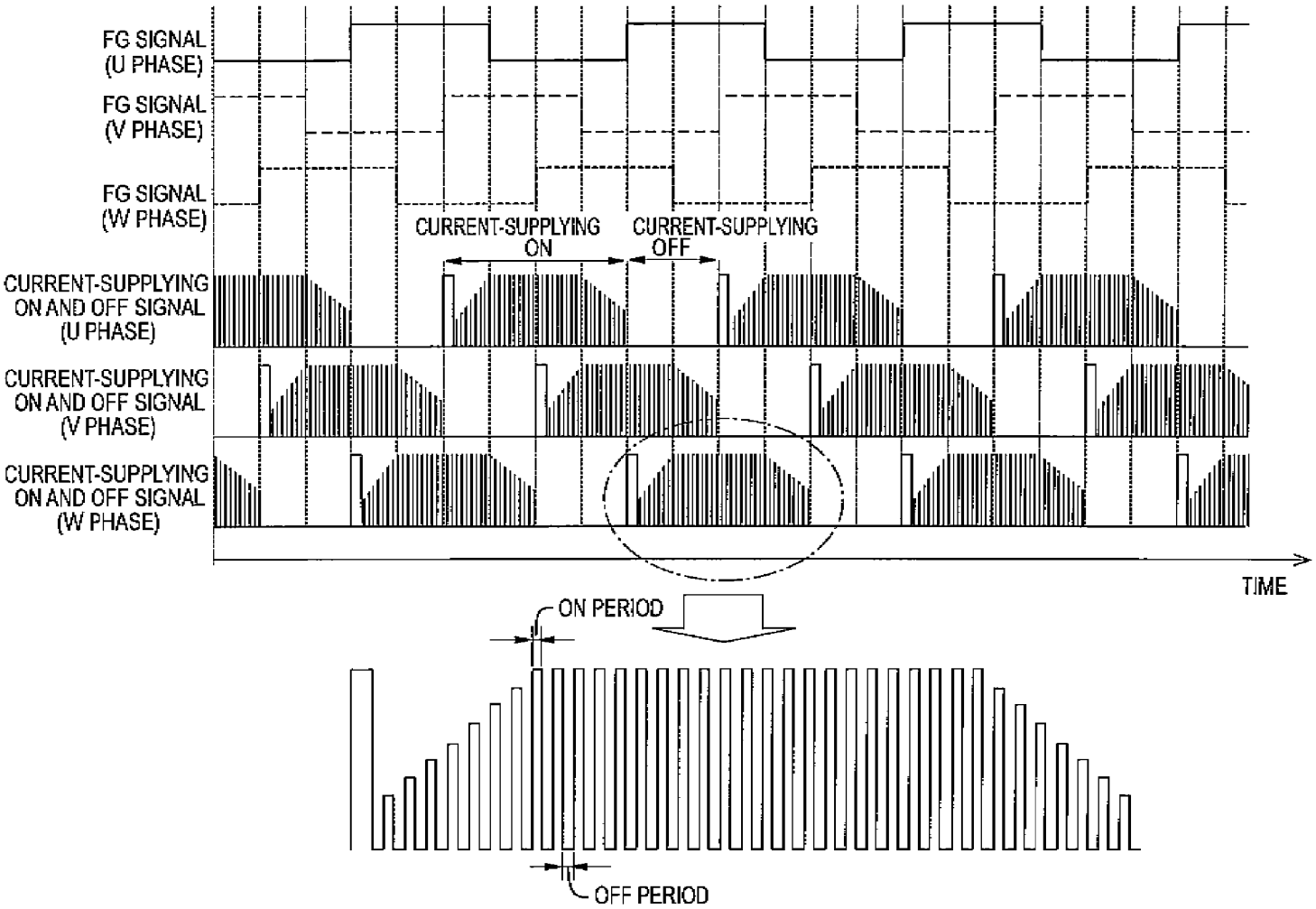
FIG. 3 is a time chart illustrating waveforms of FG signals and current-supplying on and off signals.

As illustrated in FIG. 3, the FG signals corresponding to the respective phases are fed to the control circuit 38 in waveforms with phases displaced by substantially 120° from each other. The control circuit 38 controls the switching on and off of current-supplying to the coils by feeding a current-supplying on and off signal corresponding to each of the FG signals and a PWM signal, which will be described later, to the drive circuit 37. In this way, the brushless motor 33 can be driven to rotate.

As illustrated in FIG. 2, the control board 34 is disposed away from the location of the brushless motor 33. The control board 34 and the brushless motor 33 are connected to each other via only four signal lines connected to the terminal points P of the three coils and the central point O.

(Configuration of Control Circuit)

The control circuit 38, which is an example of a control unit, controls the rotation driving of the brushless motor 33 on the basis of the FG signals, and such control will be hereafter referred to as an "FG rotation control". The control circuit 38 also controls the rotation driving of the brushless motor 33 on the basis of the BD signal, and such control will be hereafter referred to as a "BD rotation control".

Figure 4:
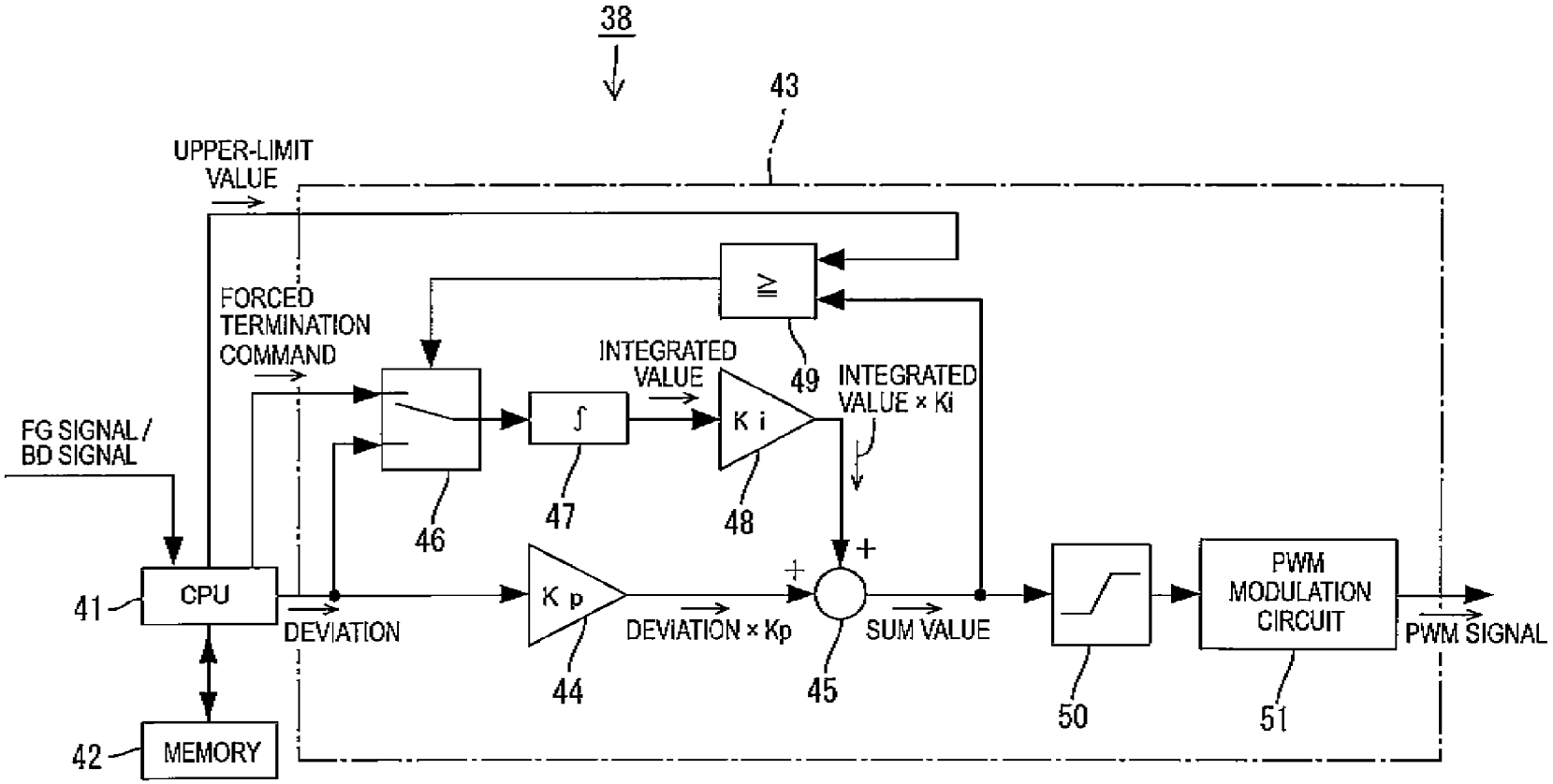
FIG. 4 is a block diagram illustrating the configuration of a control circuit.

As illustrated in FIG. 4, the control circuit 38 includes a CPU 41, a memory 42, and a PI control circuit 43. The memory 42 stores, for example, information about a target speed Vt, such as "40,000 rpm", and a prescribed range ΔVth, and a program for performing a rotation control process as will be described later. The CPU 41, during the FG rotation control, receives the three FG signals from the voltage detection circuits 39 and detects a rotation speed of the brushless motor 33 on the basis of an on and off period of at least one of the three FG signals. The rotation speed detected on the basis of the FG signals will be hereafter referred to as an "FG rotation speed". The CPU 41 also receives the BD signal from the optical sensor 32 during the BD rotation control, and detect a rotation speed of the brushless motor 33 on the basis of an on and off period of the BD signal. The rotation speed detected on the basis of the BD signal will be referred to as a "BD rotation speed".

The CPU 41 calculates a deviation between the FG rotation speed or the BD rotation speed and the target speed Vt, and feeds a voltage signal corresponding to the deviation to the PI control circuit 43 via a D/A converter which is not illustrated. In the present illustrative aspect, the deviation is a value obtained by subtracting the target speed Vt from the FG rotation speed or the BD rotation speed.

The PI control circuit 43 includes a proportional gain element 44, an addition circuit 45, a non-linear (PDF) switch 46, an integrator 47, an integration gain element 48, a comparator 49, a saturation calculation circuit 50, and a PWM modulation circuit 51. The proportional gain element 44 amplifies the deviation from the CPU 41 in accordance with a predetermined proportional gain Kp, and feeds a voltage signal corresponding to the amplified deviation to the addition circuit 45. The non-linear switch 46 switches between a non-state in which the deviation from the CPU 41 is fed to the integrator 47 and an off-state in which the deviation is not fed to the integrator 47. The integrator 47 integrates the deviation from the non-linear switch 46 and feeds a voltage signal corresponding to an integrated value to the integration gain element 48. The integration gain element 48 amplifies the integrated value from the integrator 47 in accordance with a predetermined integration gain Ki and feeds a voltage signal corresponding to the amplified integrated value to the addition circuit 45.

The addition circuit 45, on the basis of the voltage signals from the proportional gain element 44 and the integration gain element 48, sums the deviation and the integrated value of the integrator 47, and feeds a voltage signal corresponding to a resultant sum value to the saturation calculation circuit 50. The saturation calculation circuit 50 compares the sum value with a predetermined saturation value. If the sum value is not more than the saturation value, the saturation calculation circuit 50 feeds a voltage signal corresponding to the sum value to the PWM modulation circuit 51. If the sum value is more than the saturation value, the saturation calculation circuit 50 feeds a voltage signal corresponding to the saturation value to the PWM modulation circuit 51. Preferably, the saturation value is an upper-limit value of a drive current caused to flow through the coils of the brushless motor 33, such as a voltage value corresponding to 2A.

The PWM modulation circuit 51 feeds a PWM signal corresponding to a PWM value (duty ratio) obtained by PWM-modulating the voltage signal from the saturation calculation circuit 50 to the inverter 37A. The inverter 37A controls the switching-on and -off of current-supplying to the coils on the basis of the PWM signal, whereby the brushless motor 33 is driven to rotate. When the PWM value of the PWM signal is changed, the amount of current-supplying to the coils at the time of switching-on of current-supplying is changed, whereby the rotation speed of the brushless motor 33 is changed.

The CPU 41 feeds, via a D/A converter which is not illustrated, a voltage signal corresponding to the upper-limit value to the comparator 49. Preferably, the upper-limit value is substantially equal to the saturation value. The comparator 49, on the basis of the voltage signals from the addition circuit 45 and the CPU 41, has the non-linear switch 46 in the on-state when the sum value is less than the upper-limit value. Then, the integrating operation of the integrator 47 can be continued. When the sum value is not less than the upper-limit value, the comparator 49 has the nonlinear switch 46 in the off-state so as to terminate the integrating operation of the integrator 47. Thus, the integrated value of the integrator 47 can be prevented from unnecessarily increasing regardless of the saturation value.

The CPU 41 may also forcibly put the non-linear switch 46 in the off-state regardless of whether the sum value is or is not less than the upper-limit value by feeding a voltage signal indicating a forced termination command to the non-linear switch 46 via a D/A converter which is not illustrated.

(Brushless Motor Rotation Control)

Figure 5:
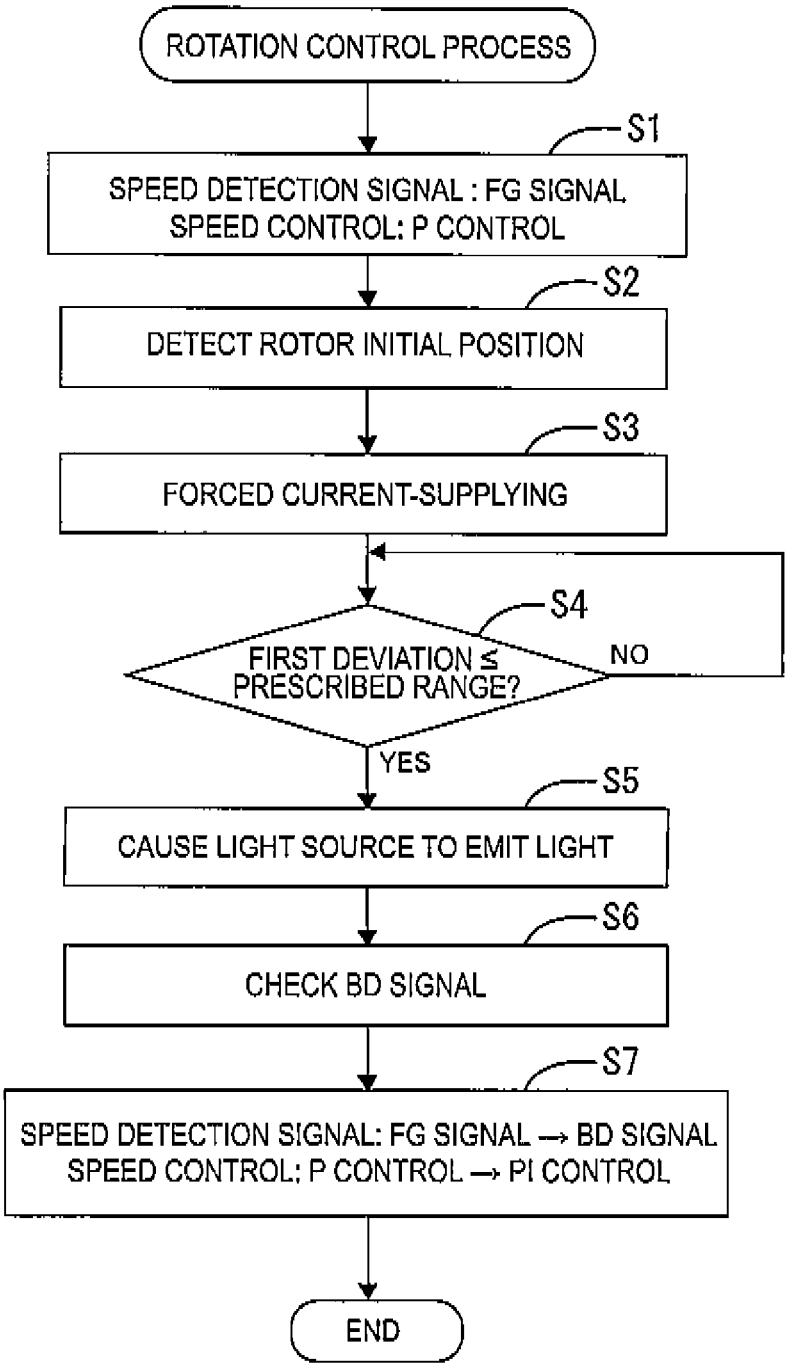
FIG. 5 is a flowchart of a brushless motor rotation control process.

The control circuit 38 performs a rotation control process for the brushless motor 33 when a predetermined start-up condition is satisfied, such as when the laser printer 1 is turned on. Specifically, the rotation control process illustrated in FIG. 5 is performed by the CPU 41 reading the program from the memory 42.

The CPU 41 starts to perform the FG rotation control by a P control by forcibly putting the non-linear switch 46 in the off-state while referring to the FG signals as speed detection signals. The CPU 41 then detects the initial position of the rotor 36, such as the position where the rotor 36 was stopped prior to starting-up (S2). Specifically, the CPU 41 may detect the initial position of the rotor 36 by controlling the drive circuit 37 so as to cause a current to flow through the coils and detecting the FG signals that are changed as the magnetic fluxes in the coils are changed by the current flow.

The CPU 41, upon detection of the initial position of the rotor 36, performs forced current-supplying (S3). Specifically, the CPU 41 performs the forced current-supplying by feeding a voltage signal based on the result of detection of the initial position to the PI control circuit and causing the drive circuit 37 to successively turn on and off current-supplying to the coils. Then, the rotor 36 can be driven to rotate. Because the induced voltages of the coils are reflected in the FG signals, the position and rotation speed of the rotor 36 can be detected on the basis of the FG signals. The CPU 41 feeds a voltage signal corresponding to a first deviation between the detected FG rotation speed and the target speed Vt to the PI control circuit 43. Thus, the PI control circuit 43 outputs a PWM signal of a PWM value which is proportional to the change in the first deviation regardless of the change in the integrated value of the first deviation. This process of FG rotation control by the P control is an example of a first rotation control process.

The CPU 41 performs a speed determination process to determine whether the first deviation is within the prescribed range ΔVth or not (S4). In the speed determination process, it may be determined whether the first deviation is in a temporary state of remaining within the prescribed range ΔVth or not. Alternatively, it may be determined whether the FG rotation speed is stabilized at around the target speed Vt or not by determining whether the state continues for a predetermined period or not.

The CPU 41, when it is determined that the first deviation is outside the prescribed range ΔVth (S4: NO), continues the FG rotation control process by the P control. On the other hand, when it is determined that the first deviation is within the prescribed range ΔVth (S4: YES), the CPU 41 causes the light source 15 to emit light (S5). As a result, the optical sensor 32 comes to periodically receive the laser light L deflected by the polygon mirror 16 and output the BD signal in accordance with the light reception timing. The timing of light emission from the light source 15 may be before S5. However, by setting the emission timing of the light source 15 in S5, the period in which the photosensitive body 10 is irradiated with the laser light L from the light source 15 can be shortened. Then, damage to the photosensitive body 10 can be prevented by the amount corresponding to the shortening.

After causing the light source 15 to emit light, the CPU 41 makes a BD signal check (S6). Specifically, the CPU 41 determines the presence or absence of the BD signal and whether a second deviation between the BD rotation speed and the target speed Vt is within the prescribed range ΔVth. The CPU 41, when the result of the BD signal check is normal, removes the forced off-state of the non-linear switch 46 while referring to the BD signal as the speed detection signal, and thereby starts to perform the BD rotation control by the PI control (S7). Specifically, the CPU 41 feeds a voltage signal corresponding to the second deviation to the PI control circuit 43. As a result, the PI control circuit 43 outputs a PWM signal of a PWM value corresponding to a change in the second deviation and a change in the integrated value of the second deviation. This process of the ED rotation control by the PI control is an example of a second rotation control process. The CPU 41 ends the BD rotation control by the PI control when a predetermined terminating condition is met, such as when a print process is completed, thereby ending the rotation control process.

(Effect of Present Illustrative Aspect)

Figure 6:
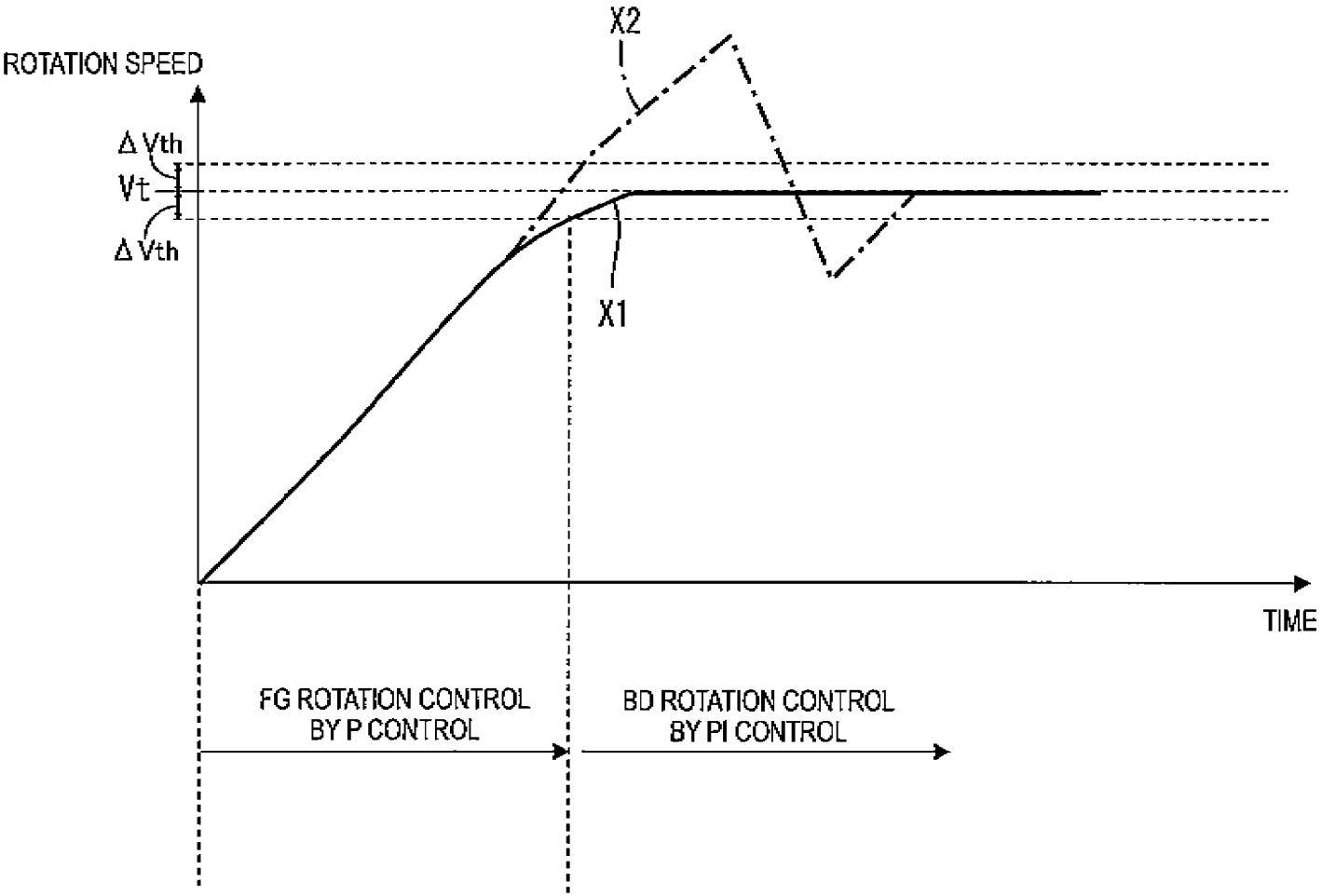
FIG. 6 is a graph illustrating chronological changes in the rotation speed of a brushless motor.

FIG. 6 is a graph illustrating chronological changes in the rotation speed of the brushless motor 33, where a solid line X1 indicates the rotation speed in the case of the rotation control process according to the present illustrative aspect, while a dot-dash-line X2 indicates the rotation speed in the case of the FG rotation control by the PI control.

The FG signals fluctuate at higher periods than the BD signal due to the influence of noise or the like. Thus, if the FG rotation control is performed by the PI control, the fluctuating component of the FG signals is integrated by the integrator 47 even when the FG rotation speed approaches the target speed Vt and, as the integrated value increases, the sum value also increases and exceeds the upper-limit value, whereupon the non-linear switch 46 is put in the off-state. As a result, even when the FG rotation speed exceeds the target speed Vt and the first deviation has a negative value, as indicated by the dot-dash-line X2 in FIG. 6, the integrated value is not subtracted and the convergence of the rotation speed of the brushless motor 33 to the target speed Vt is delayed.

On the other baud, in the present illustrative aspect, when the first deviation is outside the prescribed range ΔVth, the FG rotation control by the P control is performed. In this way, the inability to normally control the rotation of the brushless motor 33 in the FG rotation control due to the integrated factors increased by the fluctuating component of the FG rotation speed can be prevented. When the first deviation is within the prescribed range ΔVth, the BD rotation control by the PI control is performed. The BD rotation speed has less fluctuation than the FG rotation speed. Therefore, the amount of increase in the integrated value of the second deviation due to the fluctuation is relatively small. Thus, compared to the case where the FG rotation control by the PI control is performed, the rotation speed of the brushless motor 33 can be caused to converge to the target speed Vt early (see the solid line X1 in FIG. 6).

Further, by switching to the PI control that utilizes the integrated value of the second deviation in addition to the change in the second deviation, the rotation speed of the brushless motor 33 can be caused to approach the target speed while the residual deviation is suppressed, compared to the case where the P control is continued as is. In this way, the inability to normally control the rotation of the brushless motor 33 due to the fluctuation of the rotation speed caused by the change in magnetic flux of the coils can be overcome.

<Second Illustrative Aspect>

Figure 7:
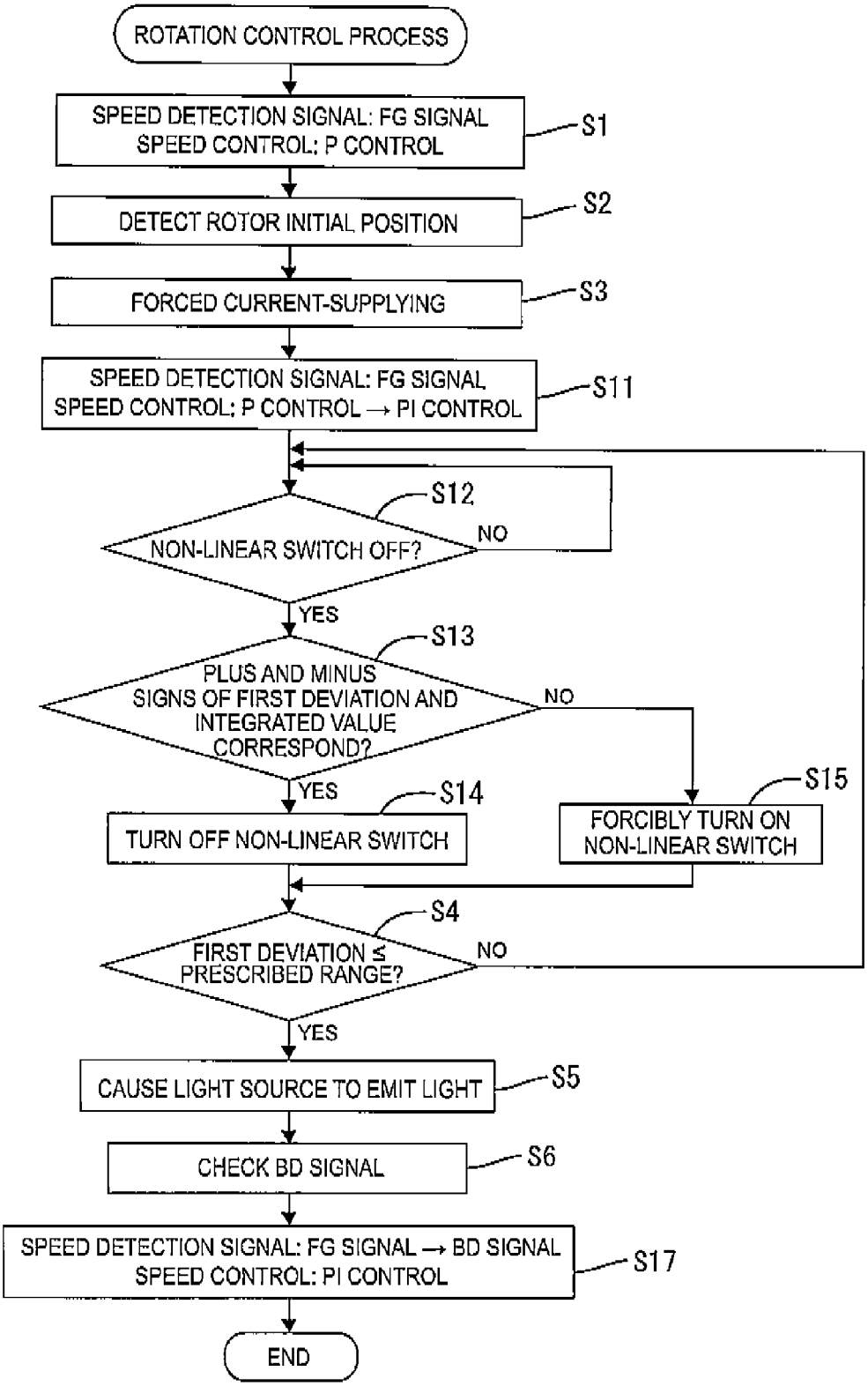
FIG. 7 is a flowchart of a brushless motor rotation control process according to a second illustrative aspect.
Figure 8:
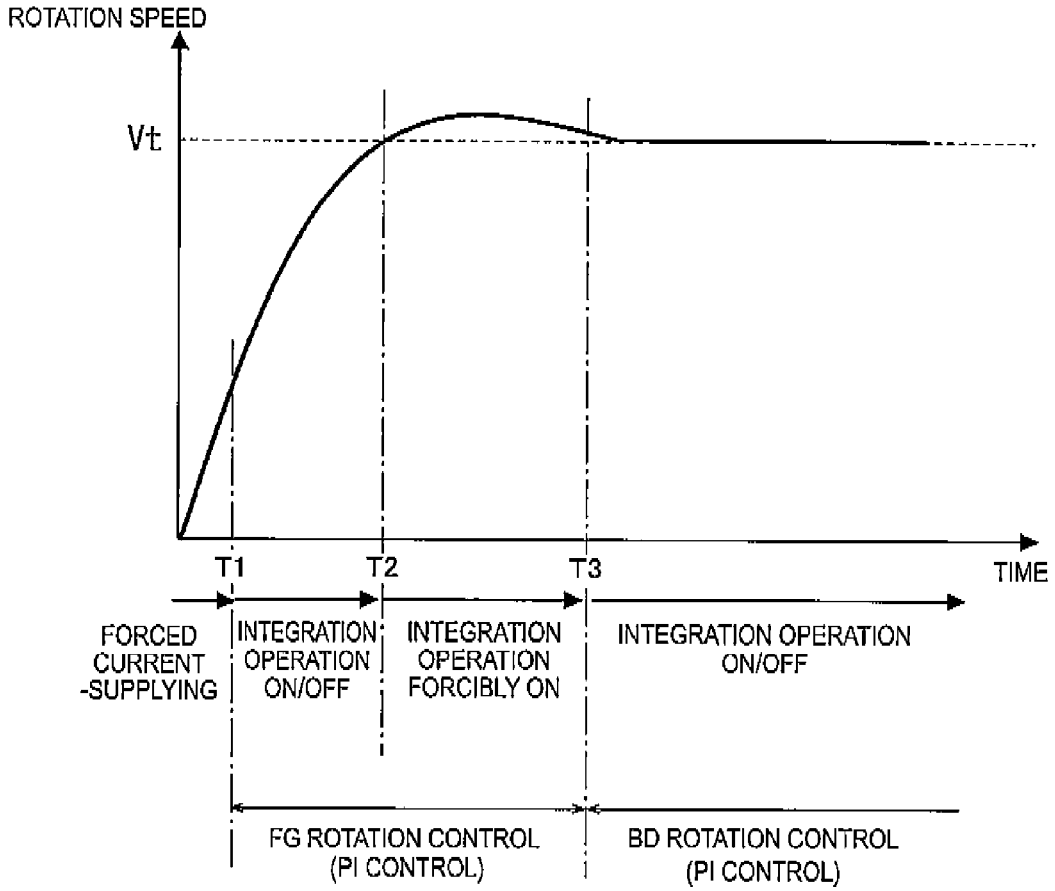
FIG. 8 is a graph illustrating chronological changes in the rotation speed of a brushless motor.

FIGS. 7 and 8 illustrate a second illustrative aspect, which differs from the first illustrative aspect in the rotation control process and is similar to the first illustrative aspect in other respects. Thus, the following description will be focused on differences from the first illustrative aspect, with similar elements designated with similar reference signs and redundant description omitted.

As illustrated in FIG. 7, the CPU 41, after performing forced current-supplying (S3) (T1 in FIG. 8), switches the FG rotation control by the P control to the FG rotation control by the PI control (S11), and then determines whether the non-linear switch 46 is in the off-state (S12). Specifically, the CPU 41, on the basis of the results of calculation by the addition circuit 45 and comparison by the comparator 49, for example, determines whether the sum value is not less than the upper-limit value or not. When it is determined that the non-linear switch 46 is in the off-state (S12: YES), the CPU 41 performs a plus or minus determination process to determine whether the plus or minus signs of the first deviation and the integrated value of the first deviation correspond with each other (S13).

The CPU 41 then performs an integrating operation switching process to switch the turning-on or -off of the integrating operation of the integrator 47 on the basis of the result of determination by the plus or minus determination process. Specifically, when it is determined that the plus or minus signs correspond to each other (S13: YES), the CPU 41 proceeds to S16 while leaving the non-linear switch 46 in the off-state. In other words, when the plus or minus signs correspond to each other and the sum value of the first deviation and the integrated value has reached the upper-limit value, the CPU 41 terminates the operation of integrating the first deviation. On the other hand, when it is determined that the plus or minus signs do not correspond (S13: NO; T2 in FIG. 8), the CPU 41 forcibly puts the non-linear switch 46 in the off state regardless of whether the sum value has reached the upper-limit value or not, forcibly performs the operation of integrating the first deviation, and then proceeds to S16.

When the first deviation is outside the prescribed range ΔVth (S16: NO), the CPU 41 returns to S12. When the first deviation is within the prescribed range ΔVth (S16: YES; T3 in FIG. 8), the CPU 41 proceeds to S5. After performing the BD signal check (S6), the CPU 41 switches the FG rotation control by the PI control to the BD rotation control by the PI control (S17).

According to the present illustrative aspect, when it is determined that the plus or minus signs do not correspond between the first deviation and the integrated value, the first deviation integrating operation is performed regardless of whether the sum value of the first deviation and the integrated value has reached the upper-limit value or not. Thus, when the first deviation has a negative value, the integrated value is subtracted. Therefore, the delay in the rotation speed of the brushless motor 33 converging to the target speed Vt can be prevented.

<Third Illustrative Aspect>

Figure 9:
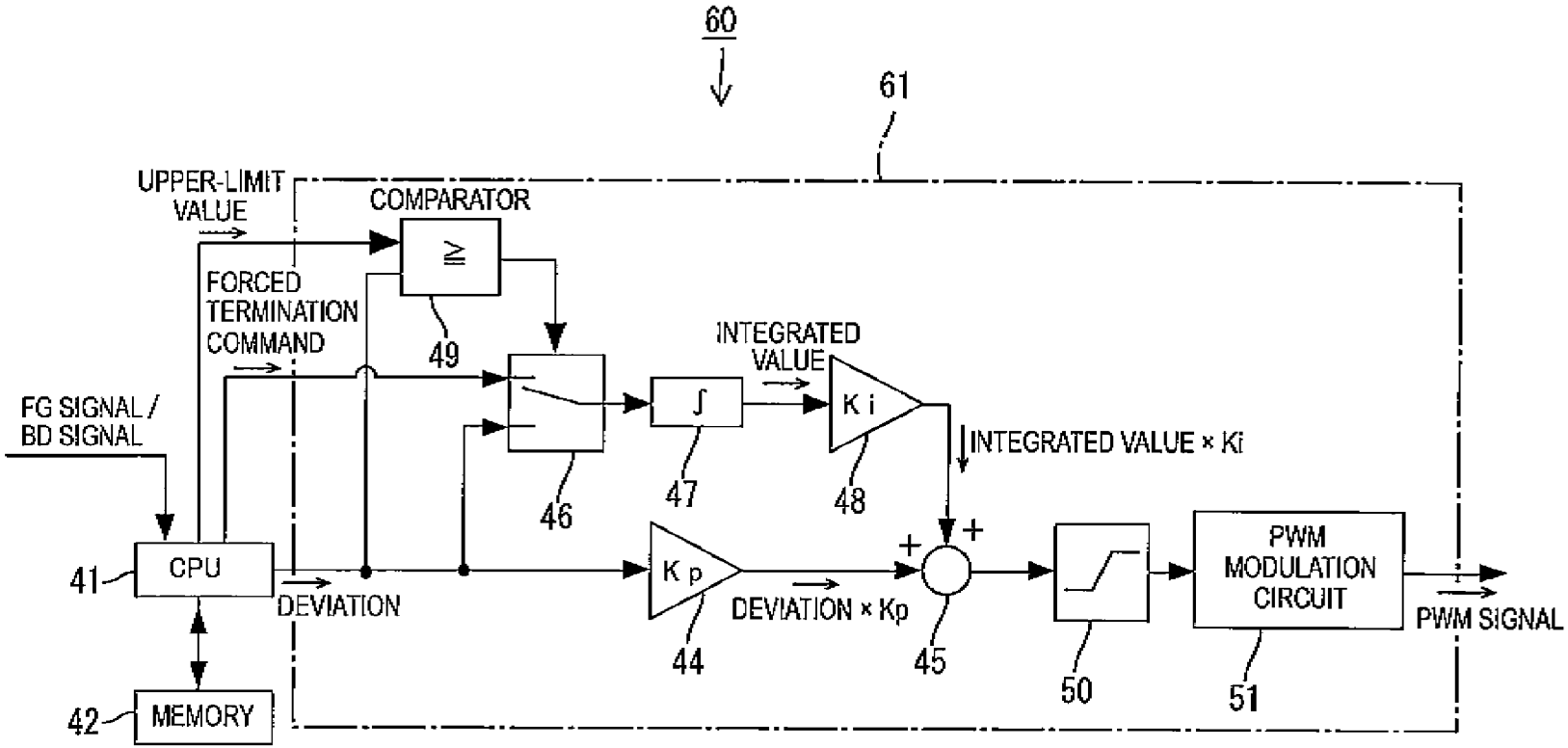
FIG. 9 is a block diagram of a control circuit according to a third illustrative aspect.

FIG. 9 illustrates a third illustrative aspect, which differs from the first illustrative aspect in the configuration of the PI control circuit and is similar to the first illustrative aspect in other respects. Thus, the following description will be focused on differences from the first illustrative aspect, with similar elements designated with similar reference signs and redundant description omitted.

In the first illustrative aspect, the PI control circuit 43 is configured such that the sum value of the deviation and the integrated value of the integrator 47 is compared with the upper-limit value by the comparator 49. In contrast, in the present illustrative aspect, as illustrated in FIG. 9, a control circuit 61 includes a PI control circuit 60 in which the comparator 49 compares the deviation with the upper-limit value. The CPU 41 performs the rotation control process of FIG. 7 except of S12 to S15. Specifically, the CPU 41, after switching the FG rotation control by the P control to the FG rotation control by the PI control (S11), determines whether the first deviation is within the prescribed range ΔVth (S16) or not. When it is determined that the first deviation is within the prescribed range ΔVth (S16: YES), the CPU 41 proceeds to S5.

According to the present illustrative aspect, the integrating operation is stopped when the deviation, not the sum value of the deviation and the integrated value, reaches the upper-limit value. Thus, even when the integrated value of the integrator 47 is increased by the fluctuating component of the FG signals, the increase does not affect the result of comparison by the comparator 49. Accordingly, the non-linear switch 46 can be prevented from being put in the off state by the increase in the integrated value, and the inability to normally control the rotation of the brushless motor 33 due to the fluctuation in rotation speed caused by the change in magnetic flux of the coils can be overcome.

<Fourth Illustrative Aspect>

Figure 10:
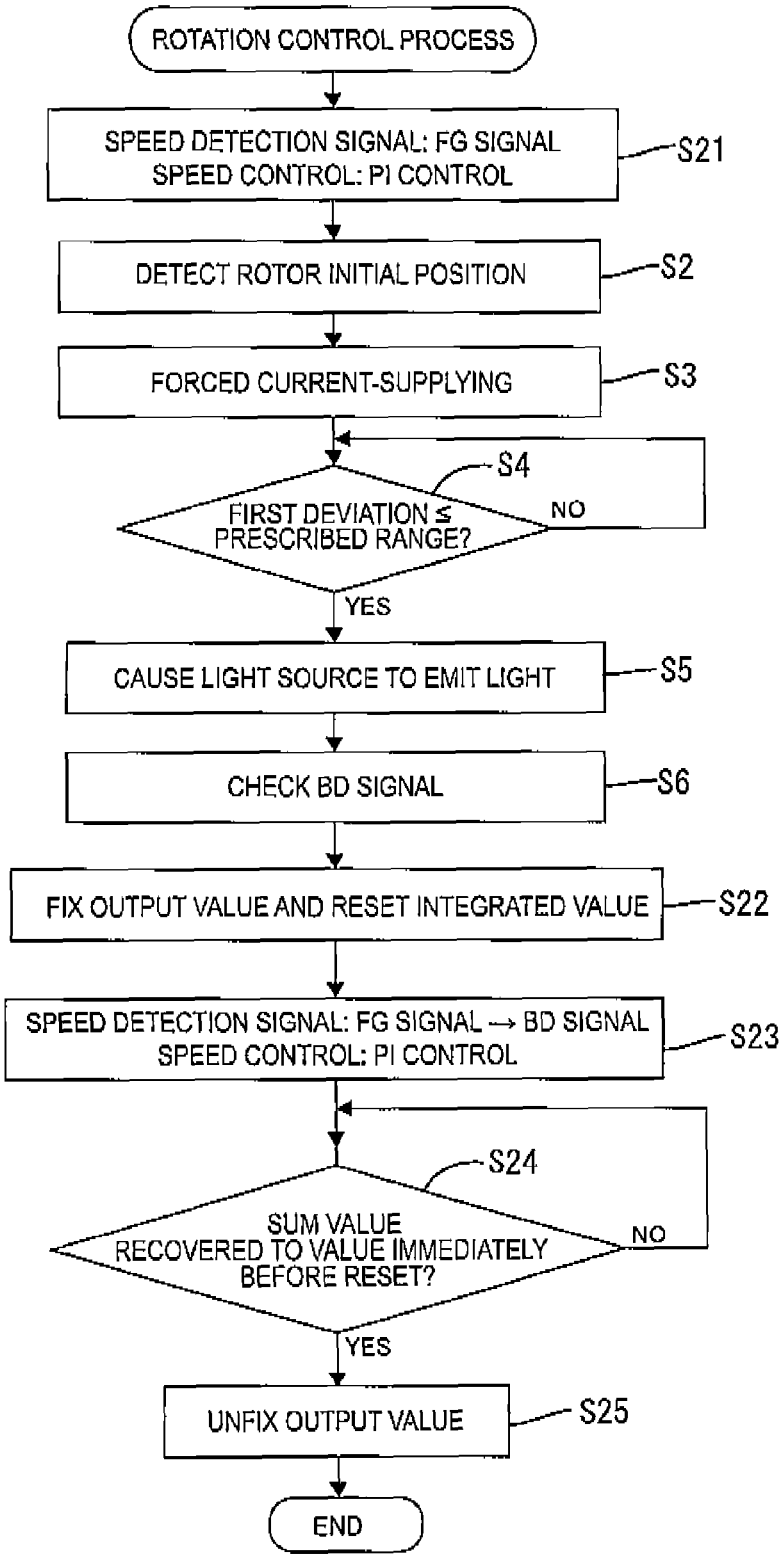
FIG. 10 is a flowchart of a brushless motor rotation control process according to a fourth illustrative aspect.
Figure 11:
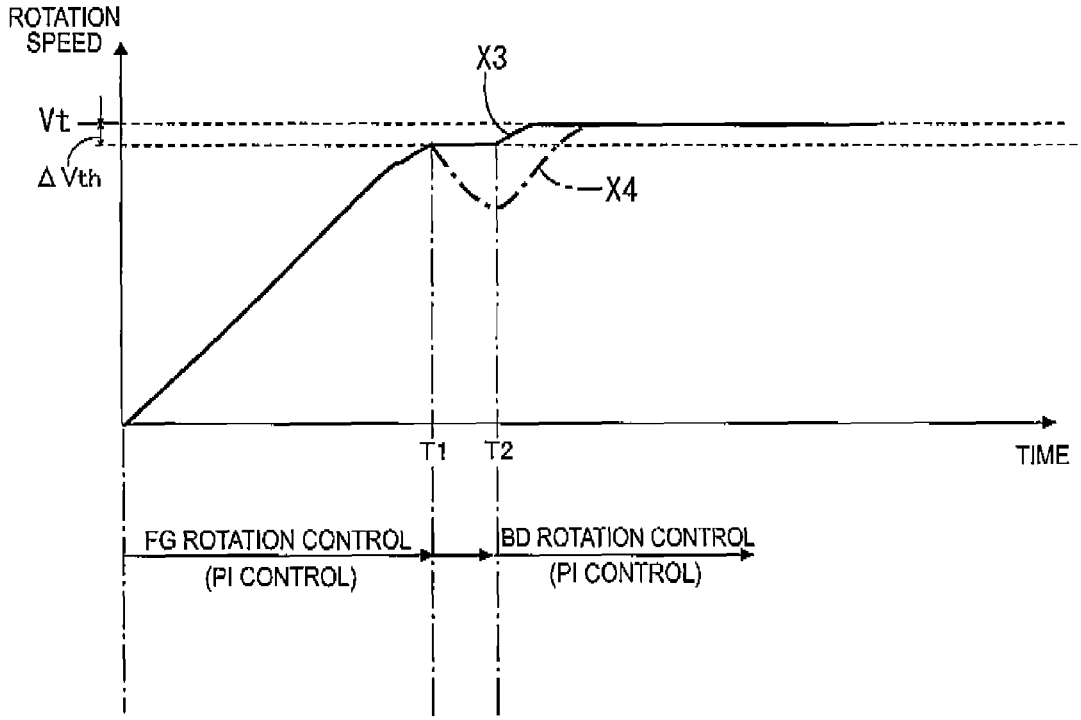
FIG. 11 is a graph illustrating chronological changes in the rotation speed of a brushless motor.

FIGS. 10 and 11 illustrate a fourth illustrative aspect, which differs from the first illustrative aspect in the rotation control process and is similar to the first illustrative aspect in other respects. Thus, the following description will be focused on differences from the first illustrative aspect, with similar elements designated with similar reference signs and redundant description omitted.

As illustrated in FIG. 10, the CPU 41 starts the FG rotation control by the PI control (S21), performs the process from S2 to S6, and then resets the integrated value of the integrator 47 to zero while fixing the PWM value of the PWM signal fed to the drive circuit 47, i.e., the output value of the control circuit 38 (S22; T1 in FIG. 11). The PWM value is fixed by the following process, for example. The CPU 41 changes a saturation upper-limit value and a saturation lower-limit value of the saturation calculation circuit 50, and detects the sum value of the addition circuit 45. The CPU 41 changes the saturation upper-limit value and the saturation lower-limit value to the sum value immediately prior to resetting the addition circuit 45 on the basis of the sum value from the addition circuit 45, thereby fixing the PWM value to the value immediately prior to resetting. The process of S22 may be performed before the process of S5 and S6.

The CPU 41 then performs the rotation control switching process to switch the FG rotation control by the PI control to the BD rotation control by the PI control (S23). When it is determined that the sum value from the addition circuit 45 has recovered to the value immediately prior to resetting (S24: YES), the CPU 41 unfixes the PWM value of the PWM signal (S25; T2 in FIG. 11). The CPU 41 may unfix the PWM value when the second deviation is within the prescribed range ΔVth.

According to the present illustrative aspect, when the first deviation enters the prescribed range ΔVth during the FG rotation control by the PI control, the integrated value of the integrator 47 is reset to zero. Thus, the integrated value of the first deviation in the PG rotation control can be prevented from being inherited to the PI control of the BD rotation control.

As opposite to the present illustrative aspect, it is possible to configure the CPU 41 to reset the integrated value of the integrator 47 to zero without fixing the PWM value of the PWM signal. However, in this configuration, the resetting may lead to a sharp decrease in the rotation speed of the brushless motor 33, as indicated by a dot-dash-line X4 of FIG. 11. According to the present illustrative aspect, the CPU 41 resets the integrated value of the integrator 47 while fixing the PWM value. Thus, the sharp decrease in the rotation speed of the brushless motor 33 by resetting is prevented, as indicated by a solid line X3 in FIG. 11. Therefore, the rotation control switching process can be performed smoothly.

<Other Illustrative Aspects>

The present invention is not limited to the illustrative aspects described above with reference to the drawings, and may include the following various illustrative aspects in the technical scope of the invention.

While the brushless motor according to the foregoing illustrative aspects is of the three-phase, outer-rotor type with the star connection, the present invention is not limited to such an illustrative aspect. The brushless motor may be adapted for two phases or four or more phases. The brushless motor may be of the inner-rotor type and may have the delta connection. In the case of the delta connection, detection signals corresponding to induced voltages may be obtained on the basis of the voltages across the terminals of each coil.

While in the foregoing illustrative aspects the polygon mirror 16 having six surfaces and the brushless motor 33 having ten poles are used, the present invention is not limited to such illustrative aspects. Preferably, the polygon mirror may have a number of surfaces other than six, and the brushless motor may have a number of poles (pole number) other than ten.

The foregoing illustrative aspects are configured such that the timing of current-supplying to the coils is controlled by detecting the position and rotation speed of the rotor on the basis of the voltages induced in the coils as the rotor rotates, without using a Hall element. Preferably, the timing of current-supplying to the coils may be controlled by placing a plurality of Hall elements near the rotor of the brushless motor and detecting the position and rotation speed of the rotor on the basis of output signals from the Hall elements. In this case, the Hall elements are an example of the magnetic flux change detection unit.

In the foregoing illustrative aspects, the control circuit 38 is provided with a single CPU. Preferably, the control circuit 38 may be provided with a plurality of CPUs or a hardware circuit, such as an application specific integrated circuit (ASIC). Specifically, while in the foregoing illustrative aspects the integration process is performed by a hardware configuration utilizing the integrator 47, the integration process may be performed by a software process of the CPU 41. Similarly, while the integrating operation terminating process is performed by a hardware configuration utilizing the non-linear switch 46 in the foregoing illustrative aspects, the integrating operation terminating process may be performed by a software process of the CPU 41. Further, at least one of the operations of the comparator 49, the addition circuit 45, the saturation calculation circuit 50, and the PWM modulation circuit 51 may be performed by a software process by the CPU 41.

In the foregoing illustrative aspects, the rotation control process, the plus or minus determination process, the integrating operation switching process, and the rotation control switching process are performed by software processes using the CPU 41. However, at least one of the above processes may be performed by a hardware circuit configuration.

The first illustrative aspect may be configured such that the integrating operation terminating process is not performed. This configuration, too, can overcome the inability to normally control the rotation of the brushless motor due to the fluctuation in rotation speed caused by the change in magnetic flux of the coils by switching the FG rotation control by the P control to the BD rotation control by the PI control when the first deviation is within the prescribed range ΔVth.

In the foregoing illustrative aspects, the program for the rotation control process is stored in the memory 42 by way of example. Preferably, the program may be stored in a nonvolatile memory such as a hard disk apparatus or a flash memory (registered trademark), or other storage media such as a CD-R.

In the foregoing illustrative aspects, a proportional integral derivative (PID) control may be performed instead of the PI control. Instead of the P control, a PD control may be performed.

In the first illustrative aspect, the CPU 41 forcibly turns off the non-linear switch 46 by feeding a forced termination command (S1 in FIG. 1), and the FG rotation control is performed in accordance with the change in the first deviation regardless of the change in the integrated value of the first deviation. Preferably, the CPU 41 may substantially terminate the integrating operation by setting the upper-limit value to the comparator 49 to zero without feeding a forced termination command to the non-linear switch 46. Thus, the FG rotation control can be performed in accordance with the change in the first deviation regardless of the change in the integrated value of the first deviation.

In the first illustrative aspect, the CPU 41 performs the FG rotation control by the P control whenever the first deviation is outside the prescribed range. Preferably, the CPU 41 may perform the FG rotation control by the PI control when the first deviation is outside a predetermined range greater than the prescribed range, and switch to the FG rotation control by the P control when the first deviation is within the predetermined range.

In the second and third illustrative aspects, the FG rotation control is switched to the BD rotation control. Preferably, the FG rotation control may be continued as is.

The configuration of FIG. 4 may be modified by eliminating the non-linear switch 46, the comparator 49, or the like, such that the PI control is performed in the FG rotation control with the integrating gain Ki set to a small first value, while the integrated value of the integrator 47 is cleared to zero and the integration gain Ki is set to a second value at the time of switching to the BD rotation control. The first value is preferably zero but may be a value other than zero that would not saturate in the saturation calculation circuit 50.

Preferably, the integrator 47 itself may be provided with a limiter preventing the non-linear switch 46 from being forcibly turned off by an increase in the integrated value. In this case, preferably, the limit value of the integrated value× Ki<the saturation value. Further, the configuration of FIG. 4 may be modified by providing the integration gain element 48 in an upper stage of the integrator 47 to sufficiently decrease the integration gain Ki.

The configuration of the fourth illustrative aspect may be modified by providing a selection element between the saturation calculation circuit 50 and the PWM modulation circuit 51, in which the CPU 41 normally feeds the output value from the saturation calculation circuit 50 to the PWM modulation circuit 51 via the selection element while causing the selection element to perform a switching operation in S22, and the CPU 41 feeds the sum value from the addition circuit 45 immediately prior to resetting to the PWM modulation circuit 51 as a fixed value. However, in the configuration of the fourth illustrative aspect, the drive circuit 37 can be on or off controlled without being affected by a rotation speed change in the brushless motor 33 during the period of the rotation control switching process (T1 to T2 in FIG. 11). Therefore, the rotation control switching process can be performed more smoothly.

In the foregoing illustrative aspects, the integrated value is reset to zero. Preferably, the integrated value may be reset to a value not more than the integrated value of the first deviation at the time of determination in S4.

What is claimed is:

1. An image forming apparatus comprising:

a light source emitting a light beam;

a photosensitive body;

a brushless motor including a stator with a plurality of coils, and a rotor with a magnet;

a rotating polygon mirror driven by the brushless motor to rotate and periodically deflect the light beam emitted by the light source so as to form scan lines successively on the photosensitive body;

a current-supplying switching unit switching on and off current-supplying to the coils so as to rotate the brushless motor;

a magnetic flux change detection unit outputting a detection signal in accordance with a change in a magnetic flux of the coils caused by the rotation of the rotor;

an optical sensor outputting a photoreception signal in accordance with the presence or absence of reception of the light beam deflected by the rotating polygon mirror; and a control unit, wherein the control unit performs:

a first rotation control process of switching on and off the current-supplying by the current-supplying switching unit in accordance with a change in a first deviation between a first rotation speed of the brushless motor based on the detection signal and a target speed regardless of a change in an integrated value of the first deviation, wherein the first rotation control process is performed using a proportional controller, and to the exclusion of the integrated value of the first deviation;

a second rotation control process of calculating an integrated value of a second deviation between a second rotation speed of the brushless motor based on the photoreception signal and the target speed, and switching on and off the current-supplying by the current-supplying switching unit in accordance with a change in the second deviation and a change in the integrated value of the second deviation;

a speed determination process of determining whether the first deviation is within a prescribed range; and a rotation control switching process of switching to the second rotation control process when, during the first rotation control process, it is determined by the speed determination process that the first deviation has entered the prescribed range from outside the prescribed range.

2. The image forming apparatus according to claim 1, wherein the control unit performs:

an integration process of calculating the integrated value of the first deviation; and an integrating operation terminating process of terminating an operation of integrating the first deviation when a sum value of the first deviation and the integrated value of the first deviation reaches an upper-limit value, wherein the control unit terminates the operation of integrating the first deviation in the first rotation control process regardless of whether the sum value reaches the upper-limit value.

3. The image forming apparatus according to claim 1, wherein the magnetic flux change detection unit detects a change in magnetic flux based on a voltage induced across each coil.

4. The image forming apparatus according to claim 1, wherein the magnetic flux change detection unit includes a voltage detection circuit that outputs a detection signal in accordance with a voltage difference between a terminal point of a coil and a central point at which the plurality of coils are connected.

5. The image forming apparatus according to claim 4, wherein the magnetic flux change detection unit includes a voltage detection circuit for each of the plurality of coils.

6. The image forming apparatus according to claim 5, wherein the plurality of coils includes a first coil, a second coil, and a third coil connected between the central point and terminal points that are disposed 120 degrees from one another.

* * * * *